United States Patent [19]

Ernst

[11] 4,019,291

[45] Apr. 26, 1977

[54] WALL SYSTEM

[75] Inventor: Gerhard Ernst, Muskegon, Mich.

[73] Assignee: American Store Equipment Corporation, Muskegon, Mich.

[22] Filed: Oct. 14, 1975

[21] Appl. No.: 622,133

[52] U.S. Cl. ..... 52/36; 52/220; 52/241; 52/481; 248/243; 52/581; 403/363

[51] Int. Cl.[2] ..... E04B 5/55; A47B 96/14

[58] Field of Search ..... 52/220, 241, 238, 272, 52/690, 696, 581, 751, 758 C, 726, 758 F, 36, 493, 753 J, 753 W, 481, 496; 403/363; 248/243; 108/108, 109

[56] References Cited

UNITED STATES PATENTS

| | | | |
|---|---|---|---|
| 1,893,636 | 1/1933 | Ridgway | 52/272 |
| 2,103,064 | 12/1937 | Clark | 52/220 |
| 2,124,519 | 7/1938 | Piersen et al. | 52/758 C |
| 2,200,159 | 5/1940 | Davis | 52/690 |
| 2,225,574 | 12/1940 | Thomson | 52/241 |
| 3,744,194 | 7/1973 | Ramberg | 52/581 |

OTHER PUBLICATIONS

Sweets Catalogue, 1973, vol. 2, Section 5.3Wh, pp. 9 and 10.

*Primary Examiner*—Price C. Faw, Jr.
*Assistant Examiner*—James L. Ridgill, Jr.
*Attorney, Agent, or Firm*—Price, Heneveld, Huizenga & Cooper

[57] ABSTRACT

The specification discloses a prefabricated wall system providing a wall frame to which plastering or a covering of dry wall sheeting may be applied. The system includes a series of wall frame sections, preferably formed from steel channel members, which sections are spaced apart and supported therebetween by channel spacers having stop means which abut the sections. Each wall frame section has vertical studs secured at top and bottom by horizontal stringers. The stringers may include an elongated slot extending for their complete length to admit utility connections within the wall and to allow cutting and telescoping of the stringers for shortening the wall section. Concealed, slotted channels may be secured to the studs intermediate the edges of the sheet covering material to provide support for shelving along the finished walls.

14 Claims, 12 Drawing Figures

WALL SYSTEM

BACKGROUND OF THE INVENTION

This invention relates to a wall system for dividing interior spaces to smaller rooms or areas and, more particularly, to a wall system including prefabricated wall framing sections to which covering sheet material or plastering may be applied.

It has been commonplace when building interior walls or partitions to individually nail a series of horizontally spaced, vertical studs intermediate elongated lengths secured to the floor and ceiling and serving as stringers for the studs. Dry wall sheeting or lathing and plastic may then be applied to the wall framework. Such method has been extremely time consuming and, therefore, increasingly expensive as labor charges for such on-site construction have increased throughout the years.

More recently, various types of prefabricated or preformed wall systems have been devised. Typically, such systems have included some type of framing to which lathing and plaster or drywall sheeting is then applied. Such systems have tended to be complex and have still required substantial labor for on-site installation. Other problems encountered with systems have included difficulty in the installation and running of utility lines and connections within the wall, the adjustment or shortening of wall sections to accommodate odd-sized areas when desired, and difficulty in securing various wall sections with respect to one another.

Another problem encountered with previous wall systems has been that of providing an aesthetically pleasing support for removable shelving systems secured along the walls. Conventionally known methods require either complicated studs or supporting structure behind the plaster or dry wall surface or application of shelving supports directly to the surface of the wall leaving the completed wall unsightly and aesthetically unpleasing.

SUMMARY OF THE INVENTION

The present invention provides a solution to the above problems by providing a wall system in which prefabricated wall sections, manufactured in standardized heights and lengths, may be easily and quickly installed at the job site with a minimum of time and labor. The system provides structure for spacing and supporting the individual wall framing sections at predetermined positions along a supporting surface and for inserting utility lines and connections to the interior of the wall. Moreover, the wall system allows easy installation of covering material such as dry wall sheeting or lathing and plaster to the wall framing sections and provides an inconspicuous, concealed structure for supporting shelving along the finished walls thereby increasing the aesthetic desirability of the completed wall.

In one aspect, the invention is a prefabricated wall system including a plurality of wall frame sections, each wall frame section including at least a pair of spaced, vertically extending studs and generally horizontal top and bottom stringers for securing the studs in horizontally spaced positions. Spacing means are included for positioning the wall sections in spaced relationship along a supporting surface. The stringers include a base and side flanges extending downwardly over the studs while the studs are secured within the stringers. The spacing means include channel means telescoped over and secured to the ends of a pair of adjacent wall frame sections for bridging the space between the sections to support the sections and stop means on said channel means for abutting the ends of the adjacent sections to space the sections at predetermined positions.

In another aspect, the invention is a prefabricated wall system wherein each wall frame section includes an elongated slot extending along the entire length of each of the top and bottom stringers. The elongated slots allow electrical wires, telephone lines, and other utility connections to be passed therethrough anywhere along the length of the stringers and also allow the stringers to be cut and slightly expanded and compressed to telescope the stringers one within the other for shortening the wall sections to fit nonstandard spaces.

In yet another aspect, the invention includes a prefabricated wall system including concealed, slotted channel means for receiving cantilever-type supports for shelving including an outwardly opening, elongated channel extending vertically between the adjacent edges of the covering surface material applied to the wall framing sections. An inwardly opening, elongated slotted channel is received within the outwardly opening channel such that aligned, vertical slots are exposed at the surface of the sheet material for attaching shelving supports.

These and other objects, advantages, purposes, and features of the invention will become more apparent from a study of the following description taken in conjunction with the drawings.

DESCRIPTION OF THE PREFERRED EMBODIMENT

Figure 1:
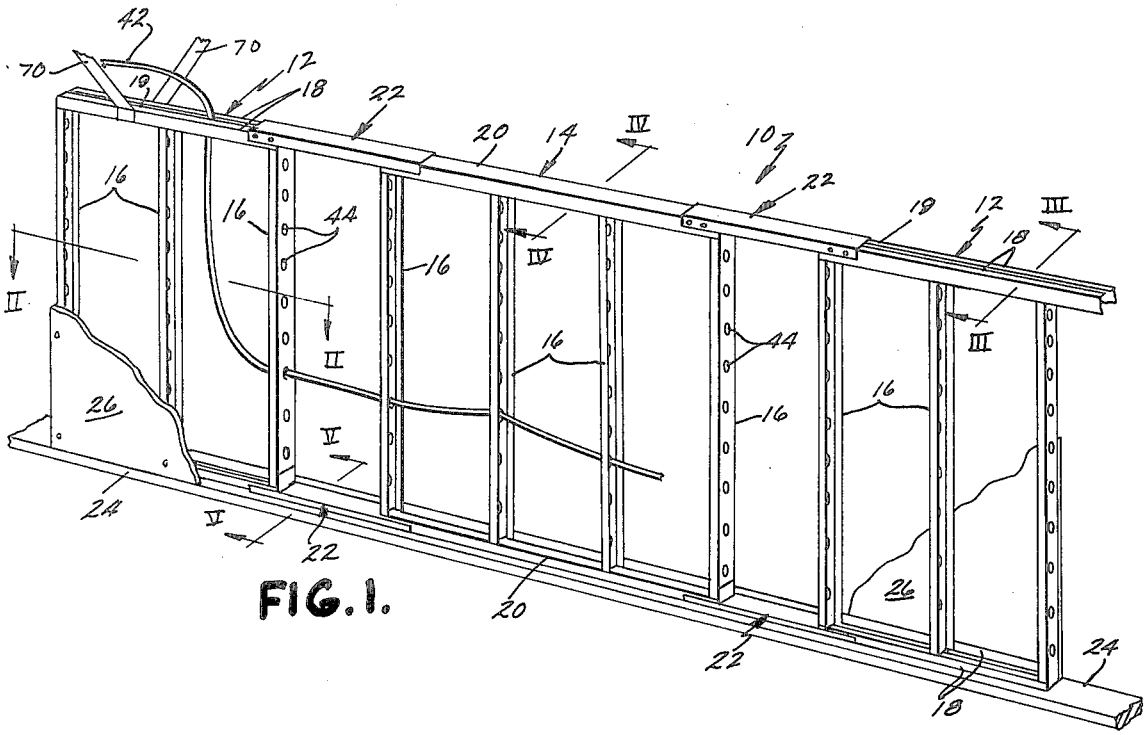
FIG. 1 is a fragmentary, perspective view of a series of prefabricated wall frame sections of the present invention secured in spaced relationship along a supporting surface and illustrating sections of dry wall sheeting secured to opposing surfaces thereof.

Referring now to the drawings in greater detail, FIG. 1 illustrates a wall 10 formed from wall frame sections 12 and 14 of the present invention. Each wall frame section 12, 14 comprises a plurality of vertically extending, channel studs 16 retained in their upright, spaced positions by top and bottom stringers 18 or 20. As explained below, stringers 18 define an elongated slot 19 therebetween while stringers 20 are solid and continuous.

The individual sections 12 and 14 are spaced apart and spliced together in predetermined spaced positions (FIG. 1) by channel-like spacers or splicers 22 which fit over and abut the ends of adjacent wall frame sections. Preferably, each of the frame sections and spacers 12, 14, and 22 are nailed or otherwise fastened to an elongated board such as a two-by-four 24 which itself is fastened to a floor surface where the wall is to be installed. Alternately, the sections and spacers can be secured directly to the floor surface. Once the wall frame sections are installed, covering material such as dry wall sheeting or sheet rock or lathing and plaster sections 26 may be applied and fastened to the upright, vertical studs and stringers along the wall sections with self-threading screws having hardened tips which are driven into the wall frame sections with power drivers.

Typically, wall frame sections 12, 14 of the present invention include anywhere from three to sixteen horizontally spaced, vertical channel studs preferably formed from steel. Such studs are spaced on two-foot centers or at other spacing as required by local construction codes. The sections may be assembled in standardized heights, typically 8, 10, or 12 feet, depending on the height of the ceiling in the room or area in which the wall is to be installed.

Figure 11:
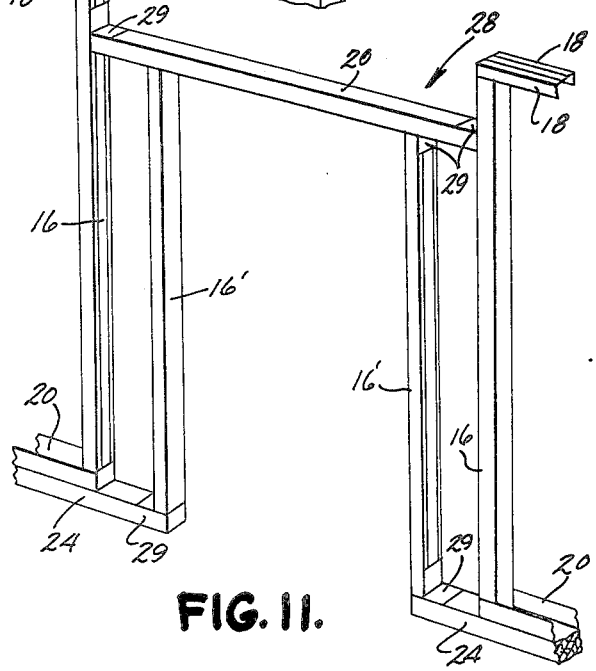
FIG. 11 is a fragmentary, perspective view of a door section which may be included in the wall system of the present invention.
Figure 12:
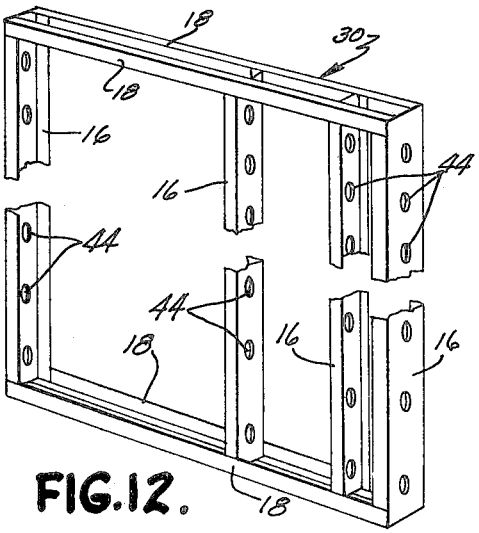
FIG. 12 is a broken perspective view of another wall frame section of the present invention having irregularly spaced, vertically extending, channel studs.

As shown in FIGS. 11 and 12, wall frame sections other than the standardized type shown at 12 and 14 in FIG. 1 may be used in the present wall system. For instance, in FIG. 11, a door frame section 28 is provided for hanging doors along the wall. In the door section shorter studs 16' and a horizontal stringer 20 are secured by welding or other fastening apparatus between standard length studs 16 with a plurality of L-brackets 29. In FIG. 12, rectangular wall frame section 30 having irregularly spaced vertical studs, i.e., a pair of vertical studs 16 closely adjacent one another toward one end of the section is illustrated for additional structural support in wall corners. As with the other sections, each section 28, 30 is typically comprised of vertical steel channel studs 16 and horizontal stringers 18 or 20 and may be secured atop a two-by four or other platform board or secured directly to the support surface or floor.

Figure 10:
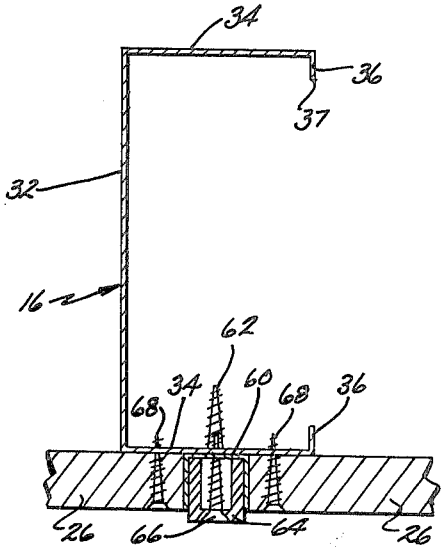
FIG. 10 is a sectional plan view of the slotted channel secured to a wall frames section taken along plane X-X of FIG. 9.

As is best seen in FIGS. 1, 2, 6, and 10, each of the vertically upright, steel channel studs 16 includes a base sections 32 extending generally transversely of the general plane of the wall section. A pair of generally parallel channel side flanges 34 extend outwardly in the same direction from spaced ends of the base 32 and may include short end flanges 36 for rigidifying the channel which extend toward one another from the outer edges of the side flanges 34 (FIG. 10). Flanges 34, 36 define a channel opening 37 (FIG. 10) which opens generally in the plane of the wall section to facilitate passage of utility lines within the wall.

Figure 2:
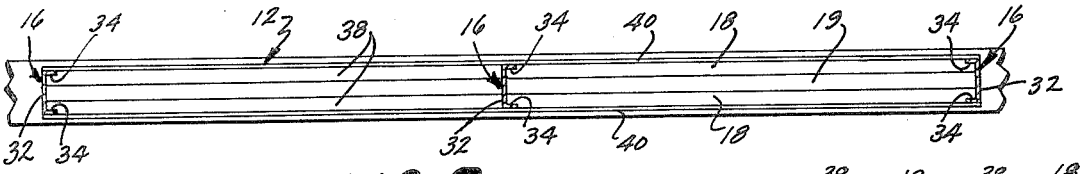
FIG. 2 is a sectional, plan view of one of the prefabricated wall frame sections taken along plane II-II of FIG.1.
Figure 3:
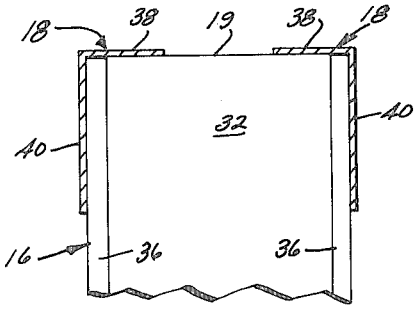
FIG. 3 is a fragmentary end view of one of the wall framing sections including a completely slotted stringer taken along plane III-III of FIG. 1.

As is best seen in FIGS. 1, 2, 3, and 4, the horizontal stringers 18, 20 provide top and bottom caps fitting over the ends of the vertical studs 16. Studs 16 telescope within and are preferably welded to the stringers 18, 20. As seen in FIGS. 2, and 3, stringers 18 are generally L-shaped in cross section and include base leg flanges 38 and side flanges 40 which extend downwardly in generally vertical planes along the side flanges 34 of the vertical steel channels 16. When secured along the top and bottom edges of the vertical studs, the stringers 18 define top and bottom elongated slots 19 extending along the complete and entire length of the wall section and the length of the stringers 18 between base leg flanges 38.

Elongated slots 19 serve dual functions. First, as shown in FIG. 1, electrical lines, telephone lines, and other utility lines and connections 42 may be admitted either upwardly or downwardly through the slots 19 from above or below the wall sections such that the lines may be run through the interior of the wall frame sections. Once admitted to the interior of the wall sections through slots 19, utility lines 42 may be passed through the circular apertures 44 spaced vertically along the elongated base section 32 of the vertical studs 16 and through channel openings 37 for passage to the desired area of the wall.

Secondly, slots 19 allow frame sections 12, 14, 30 to be severed or cut through stringers 18 in a generally vertical plane. Stringer portions on one side of the cut may be slightly compressed and those on the other side of the cut slightly expanded such that one set of cut stringers may be telescoped within the other opposite set. Thereafter, the stringers may be welded or otherwise fastened in their telescoped positions to provide a simple and rapid method for shortening the rectangular wall frame sections at the installation site without the necessity for abutting solid channel sections and welding the same. To facilitate such compression and expansion of stringers 18, they are typically formed from a relatively thin gauge steel which allows slight flexing.

Figure 4:
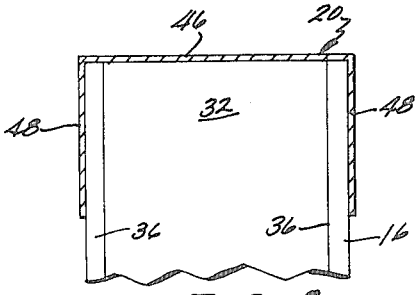
FIG. 4 is a fragmentary end view of one of the wall frame sections including a solid, continuous stringer taken along plane IV-IV of FIG. 1.

Alternatively, the stringers may be utilized in solid or continuous form as shown at 20 in FIG. 4. Stringers 20 include a continuous or solid, generally planar base 46. Spaced, generally parallel, side flanges 48 extend downwardly from the spaced edges of the base 46. Like stringers 18, solid stringers 20 cap the end portions of the vertical studs and are welded or secured to the side flanges 34 of the vertical studs. Should shortening of the sections including the solid or continuous stringers 20 be necessary, such stringers may be cut and a section thereof removed after which the ends of the shortened wall frame section portions may be abutted against one another and welded or otherwise secured.

In order to space and support the separate rectangular wall frame sections 12, 14, 30, individual channel-like spacers 22 are utilized as bridges at the tops and bottoms of the wall sections therebetween. As best seen in FIGS. 5–8 , spacers or splicers 22 include an elongated channel 50 having a base 52 and downwardly extending, generally parallel, side flanges 54 extending from spaced side edges of the base. Channel 50 has an inside dimension slightly wider than the overall width of the wall frame sections 12, 14, or 30 such that the channel will telescope over the stringers 18 or 20 at the top and bottom of the sections. Welded or otherwise secured within the channel 50 are a pair of spaced, generally L-shaped flanges 56 having one leg secured to the inside surface of the base 52 and the other leg projecting downwardly and parallel to the corresponding leg of the other flange 56 in the direction that channel 50 opens. The downwardly projecting legs of L members 56 extend across the entire width of the interior of the channel 50. Members 56 are spaced inwardly from the ends of the channels 50 such that the distance between members 56 corresponds to the distance desired between the wall sections 12, 14, or 30. The spacing of the end studs 16 on such sections is thus predetermined so that overall spacing of the studs is maintained on two-foot centers or as required by local codes.

Figure 5:
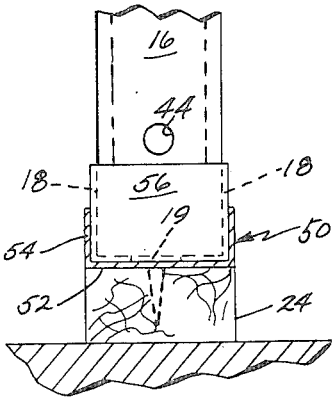
FIG. 5 is a fragmentary end view of one of the wall framing sections secured in spaced relationship by a channel-like spacer taken along plane V-V of FIG. 1.
Figure 6:
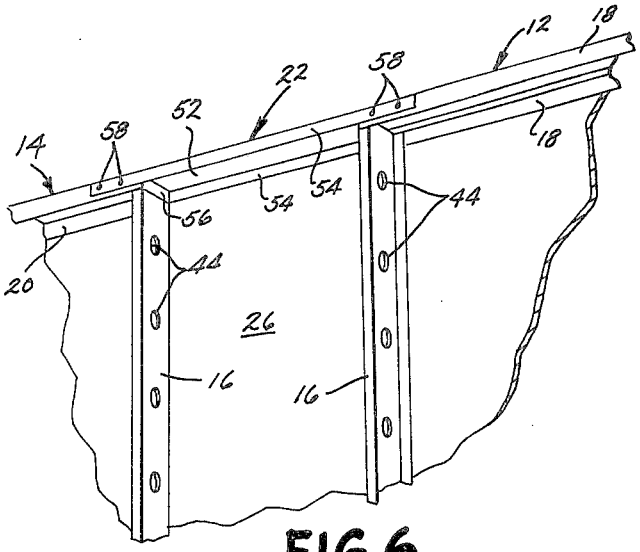
FIG. 6 is a fragmentary, persective view of the channel-like spacer securing two adjacent wall frame sections in spaced relationship.
Figure 7:
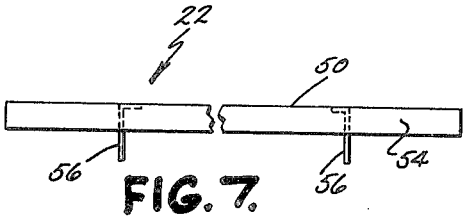
FIG. 7 is a broken side elevation of the channel-like spacer shown in FIGS. 1, 5, and 6.
Figure 8:
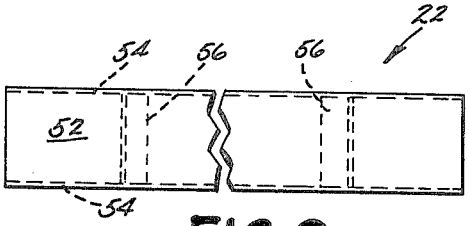
FIG. 8 is a broken plan view of the channel-like spacer shown in FIGS. 1 and 5–7.

As shown in FIGS. 1, 5, and 6, the sections are fitted within the ends of the spacer 22 such that members 56 abut the end surfaces of end studs 16 while the ends of the channel 50 telescope over the stringers adjacent the ends of the wall sections. A pair of self-threading fastening screws 58 are inserted or secured through the side flanges 54 of the spacer and into the stringer side flanges at each end on each side of the spacers to secure them in place as shown in FIGS. 1 and 6. As with the attachment of the dry wall sheeting or covering sheet material, fasteners 58 may be of the hardened tip, self-threading variety.

Figure 9:
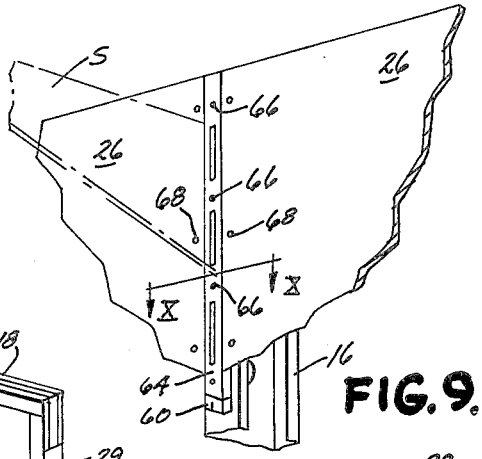
FIG. 9 is a fragmentary, perspective view of the concealed, slotted shelving support secured between adjacent edges of dry wall sheeting on a wall frame section of the present invention.

Referring now to FIGS. 9 and 10, the wall system of the present invention may be provided with a unique concealed apparatus for supporting shelving along the sides of the finished wall surfaces. As is best seen in FIG. 10, an outwardly opening, elongated channel member 60 is secured vertically to the vertically extending side flange 34 of one of the vertical studs 16 by a series of self-tapping, hardened tip securing screws 62 extending through the base of the outwardly opening channel. The side flanges of channel 60 extend generally parallel to one another outwardly from the base thereof and are coterminous, generally flush with, and therefore have a length approximating the thickness of, the covering sheet material or dry wall sheeting 26 to be applied over the wall frame sections.

Received within the channel 50 is an inwardly opening, vertically slotted, shelving support channel or standard 64 having an outside width slightly less than the interior width between the side flanges of channel 60. Channel 64 is secured through its base section, which is exposed generally at the surface of the dry wall sheeting or covering sheet material 26, with a series of hardened tip, self-threading screws 66. The dry wall sheeting is secured to the upright side flange of channel 16 on either side of channel 60 with similar hardened tip, self-threading screws 68 such that the channel 60 forms a spacer when the dry wall sheeting or covering sheet material is applied to the wall frame sections. The resulting finished wall includes the slotted shelving support channel in an inconspicuous, aesthetically pleasing manner. The exposed surface of channel 64 includes the vertically aligned slots for receiving cantilever shelf supports of the type shown at S in FIG. 9. The exposed surface is generally flush with the surface of the sheet rock or covering material 26. Installation of the slotted channel is simple and easy with the self-fitting screws because the outwardly opening channel 60 automatically spaces the sheet material when applied.

As will now be appreciated, the individual wall frame sections 12, 14, 28, or 30 may be individually installed quickly and easily at the job site along a floor surface or two-by-four 24 on such floor surface and simultaneously spaced at a predetermined stud spacing with spacers 22 as described above. Thereafter, outwardly opening channel 60 and slotted shelving support channels 64 may be secured to the vertically extending studs 16 in desired locations and utility lines, such as electrical and telephone lines 42, may be inserted through slots 19 into the interior of the wall. Should the wall require additional bracing to the existing ceiling in the room being partitioned, ceiling braces 70 may be attached between the stringers and the existing ceiling (FIG. 1).

Thereafter, the covering material such as dry wall sheeting 26 is quickly and easily applied to the side surfaces of the wall frame section with self-threading, hardened tip screws 68 (FIG. 10). The wall is then complete and ready for sealing of the joints between the dry wall sheets and for painting. On-site installation time is drastically reduced from conventional construction methods. Spacing of the individual wall frame sections is simple and easy as is shortening of the wall sections in odd-sized spaces using the compression and expansion techniques described above with the slotted stringers 18. Moreover, the concealed, flush mounting of the slotted, shelving support channels 64 provides an aesthetically pleasing finishing touch for the completed wall.

While several forms of the invention have been shown and described, other forms will now be apparent to those skilled in the art. Therefore, it will be understood that the embodiments shown in the drawings and described above are merely for illustrative purposes and are not intended to limit the scope of the invention which is defined by the claims which follow.

The embodiments of the invention in which an exclusive property or privilege is claimed are defined as follows.

1. A prefabricated wall system comprising a wall frame section having at least a pair of spaced, vertical studs and top and bottom stringers for securing said studs in horizontally spaced positions; a covering material such as dry wall sheeting or the like secured to at least one side of said wall frame section; and generally concealed, slotted channel means for receiving cantilever-type supports for shelving or the like including an outwardly opening, elongated channel extending vertically along one of said studs at the side of one of said wall frame sections, the edges of said covering material abutting either side of said channel with the edges of said channel being generally flush with the surface of said covering material, and an inwardly opening, elongated, slotted channel received within said outwardly opening channel such that a series of aligned, vertical slots are exposed at the surface of said covering material; and means for securing said slotted channel within said outwardly opening channel and for securing said outwardly opening channel to said stud.

2. The wall system of claim 1 wherein said stud has a channel-shaped cross section with a base extending transversely across the thickness of said wall frame section and side flanges extending from said base and along the side of said wall frame section; said outwardly opening channel being secured to one of said stud side flanges.

3. A prefabricated wall system providing a wall frame to which a covering material such as dry wall sheeting or the like is applied, said system comprising a plurality of prefabricated wall frame sections and securing means for securing said wall sections at spaced positions along a supporting surface; each wall frame section including at least a pair of horizontally spaced, vertically extending studs and top and bottom stringers for securing said studs in horizontally spaced positions; said stringers including a pair of elongated, L-shaped angle members extending along and secured to corresponding top, bottom, and side surfaces of said studs and defining an elongated slot extending the entire length of said wall section on both its top and bottom; said stringer slots allowing electrical wires, telephone lines, and other utility connections to be passed therethrough anywhere along the length of said stringers and also allowing said stringers to be cut transversely intermediate said studs; the stringers, when cut, being compressible slightly toward one another for telescoping within the stringers on the opposite side of said cut which are slightly expansible, the telescoped stringers thereafter allowing fastening whereby said wall frame section can be shortened as desired.

4. The wall system of claim 3 wherein each of said studs has a channel-shaped cross section with a base and side flanges extending outwardly from said base to define an elongated, vertical opening which opens generally in the plane of said wall section.

5. A prefabricated wall system providing a wall frame to which a covering material such as dry wall sheeting or the like is applied, said system comprising a plurality of prefabricated wall frame sections and spacing means for positioning said wall sections in spaced relationship along a supporting surface; each wall frame section including at least a pair of spaced, vertically extending studs and generally horizontal top and bottom stringers for securing said studs in horizontally spaced position said stringers including a base and side flanges extending over said studs, said studs being secured to said stringers; means for securing said wall frame sections to support surface; said spacing means including channel means telescope over the vertical extremities of and secured to the ends of a pair of adjacent wall frame sections for briding the space between said sections to support said sections and stop means on said channel means for abutting the ends of said adjacent sections to space said sections at predetermined positions on the supporting surface; said channel means being slightly larger in size than said stringers and studs so as to fit over and seat on the vertical extremities of said wall frame sections and including base means for supporting said spacing means on the vertical extremities of said adjacent wall sections and side means extending from said base means for confining said wall frame sections within said channel means; said stop means extending internally of said channel means and abutting the outer end surfaces of said adjacent wall frame sections; and means for securing said spacing means to said adjacent wall frame sections.

6. The wall system of claim 5 wherein said stringers in at least one of said wall frame sections on both the top and bottom thereof include elongated channel members having a continuous base, and side flanges extending over said studs from the spaced side edges of said continuous base.

7. The wall system of claim 5 including covering material secured to at least one side of said wall frame sections and means for attaching said covering material to said side of said sections; and generally concealed, slotted channel means for receiving cantilever-type supports for shelving or the like including an outwardly opening, elongated channel extending vertically along one of said studs at the side of one of said wall frame sections, the edges of said covering material abutting either side of said channel with the edges of said channel being generally flush with the surface of said covering material, and an inwardly opening, elongated, slotted channel received within said outwardly opening channel such that a series of aligned, vertical slots are exposed at the surface of said covering material; and means for securing said slotted channel within said outwardly opening channel and for securing said outwardly opening channel to said stud.

8. The wall system of claim 7 wherein said stud has a channel-shaped cross section with a base extending transversely across the thickness of said wall frame sections and side flanges extending from said base and along the side of said wall frame section; said outwardly opening channel being secured to one of said stud side flanges.

9. The wall system of claim 5 wherein said channel means include at least one channel member having a base and spaced, downwardly extending side flanges; said stop means including a pair of flanges extending transversely between said side flanges of said channel member and spaced apart a predetermined distance corresponding to the desired spacing of said wall sections.

10. The wall system of claim 9 wherein said flanges of said stop means are L-shaped angle brackets having one leg thereof fastened to said base within said channel member and the other leg extending downwardly within the channel interior; and threaded frasteners for securing each end of said channel member to one of said wall frame sections.

11. The wall system of claim 5 wherein each of said studs has a channel-shaped cross section with a base and side flanges extending outwardly from said base to define an elongated, vertical opening which opens generally in the plane of said wall section.

12. The wall system of claim 11 wherein said base of each of said studs includes a plurality of spaced apertures for receiving therethrough electrical wiring, telephone lines, and other utility services interior of said wall frame sections.

13. The wall system of claim 5 wherein said stringers on at least one of said wall frame sections include an elongated, open slot each stringer completely along the entire length of the base of eachstringer on both the top and bottom of each wall frame section, said slot allowing electrical wires, telephone lines, and other utility connections to be passed therethrough anywhere along the length of said stringers and also allowing said stringers to be cut transversely intermediate said studs; the stringers, when cut, being compressible slightly toward one another and for telescoping within the stringers on the oppoiste side of said cut which are slightly expansible, the telescoped stringers thereafter allowing fastening whereby said wall frame section can be shortened as desired.

14. The wall system of claim 13 wherein said stringers on both the top and bottom of said wall section include a pair of elongated, L-shaped angle members, each angle member extending along and being secured to the corresponding corners and side surfaces of the successive stud members in said wall section.

* * * * *

UNITED STATES PATENT AND TRADEMARK OFFICE

CERTIFICATE OF CORRECTION

PATENT NO. : 4,019,291

DATED : April 26, 1977

INVENTOR(S) : Gerhard Ernst

It is certified that error appears in the above-identified patent and that said Letters Patent are hereby corrected as shown below:

Column 2, line 64;
"frames" should be --frame--;
Column 3, line 61;
"sections" should be --section--;
Column 4, line 29;
After "allow" insert --wall--;
Column 7, Claim 5, line 38;
"telescope" should be --telescoped--;
Column 7, Claim 5, line 40;
"briding" should be --bridging--;
Column 8, Claim 13, line 49;
"eachstringer" should be --each stringer--;
Column 8, Claim 13, line 57;
"oppoiste" should be --opposite--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademark*